US006129158A

United States Patent [19]

Yamamoto et al.

[11] Patent Number: 6,129,158

[45] Date of Patent: Oct. 10, 2000

[54] HYDRAULIC SYSTEM FOR BULLDOZER

[75] Inventors: Shigeru Yamamoto; Hidekazu Nagase, both of Hirakata, Japan

[73] Assignee: Komatsu Ltd., Tokyo, Japan

[21] Appl. No.: 09/331,227

[22] PCT Filed: Oct. 29, 1997

[86] PCT No.: PCT/JP97/03957

§ 371 Date: Jun. 18, 1999

§ 102(e) Date: Jun. 18, 1999

[87] PCT Pub. No.: WO98/29615

PCT Pub. Date: Jul. 9, 1998

[30] Foreign Application Priority Data

Dec. 27, 1996 [JP] Japan ..... 8-350349

[51] Int. Cl.[7] ..... E02F 3/85

[52] U.S. Cl. ..... 172/812

[58] Field of Search ..... 701/50; 172/812, 172/811, 810, 2, 3, 7, 11, 12

[56] References Cited

FOREIGN PATENT DOCUMENTS

| | | |
|---|---|---|
| 61-60931 | 3/1986 | Japan . |
| 63-63830 | 3/1988 | Japan . |
| 4-37650 | 3/1992 | Japan . |
| 8-260506 | 10/1996 | Japan . |

*Primary Examiner*—Christopher J. Novosad

*Attorney, Agent, or Firm*—Armstrong, Westerman, Hattori, McLeland & Naughton

[57] ABSTRACT

An extensive torsional force exerted on a vehicle body frame due to an operation of blade lift cylinders can be avoided. Determination is made to identify an occurrence condition which causes a torsional force on a vehicle body frame due to an operation of the blade lift cylinders 9. If a condition which causes a torsional force is identified, pressure oil supplied to the blade lift cylinders 9 through a lift control valve 26 is interrupted, thereby stopping the operation of the blade lift cylinders 9. Alternatively, the operation speed of the blade lift cylinders 9 may be reduced by limiting the flow rate of pressure oil supplied to the blade lift cylinders 9.

16 Claims, 4 Drawing Sheets

HYDRAULIC SYSTEM FOR BULLDOZER

FIELD OF THE INVENTION

The present invention generally relates to bulldozer hydraulic systems and, more particularly, to a technique for controlling the operation of blade lift cylinders operable to raise and lower the blade of a bulldozer.

BACKGROUND OF THE INVENTION

Generally, when a bulldozer blade is raised or lowered with the bulldozer blade tilt-operated, i.e., with either one of the right and left ends of the bulldozer blade tilted downward, this causes one of the blade lift cylinders to quickly arrive at its stroke end, as a result of which an extensive force is exerted upon only the other blade lift cylinder. This sometimes brings about an undesirable situation in which there occurs an extensive torsional stress in a structural member (e.g., a radiator guard) for supporting the blade lift cylinder in question or in the vehicle body frame. For this reason, structural members for supporting blade lift cylinders have been made solid enough to withstand an extensive torsional stress.

In order to address with the above-described problem, there has been reported some techniques. For example, Japanese Utility Model Publication (KOKAI) Gazette No. 4-37650 (1992) discloses a system, wherein the difference between stroke values of the right and left tilt cylinders is used to detect a blade lateral tilt angle. When the blade lateral tilt angle exceeds an allowed value, the tilt limit valve is actuated for the avoidance of interference between the bulldozer blade and the vehicle body. Japanese Patent Publication (KOKAI) Gazette No. 63-63830 (1988) shows a system as another related technique. In accordance with this system, when the bulldozer blade in a tilt state is in the vicinity of the limit of ascent/descent thereof, it is arranged such that the flow rate of pressure oil, which is pressure-supplied to the lift cylinders for raising and lowering the bulldozer blade, is gradually diminished for the avoidance of impact due to the lift cylinders arriving at their stroke ends.

However, the above-described method, in which structural members for supporting the blade lift cylinders are reinforced in structural strength, is problematic in that the bulldozer body becomes heavier in weight and in addition, manufacturing costs increase.

One of the above-described publications is intended for the prevention of interference between the bulldozer blade and the vehicle body at tilt operation time, whereas the other publication is intended for the relaxation of impact that occurs when the lift cylinders reach their stroke ends. Consequently, these techniques fail to provide any effective solution essential to a reduction in torsional force occurring in the body frame when the bulldozer blade is operated to ascend or descend while being tiltoperated.

In consideration of the above-described drawbacks with the prior art techniques, the present invention was made. Accordingly, an object of the present invention is to provide an improved hydraulic system for use in a bulldozer capable of preventing the occurrence of exertion of an extensive torsional force upon the vehicle body frame due to the operation of the blade lift cylinders.

DISCLOSURE OF THE INVENTION

In order to achieve the above-described object, the present invention provides a first hydraulic system for use in a bulldozer in which a blade is raised or lowered by means of two lift cylinders. The first hydraulic system of the present invention comprises:

(a) a lift operation valve for switching the direction of operation of the lift cylinders by switching the direction of pressure oil which is supplied to the lift cylinders;

(b) torsional force occurrence condition identifying means for identifying an occurrence condition which causes a torsional force exerted on a vehicle body frame owing to an operation of the lift cylinders, and (c) lift cylinder controlling means for stopping the lift cylinders from operating, by interrupting, in response to a signal from the torsional force occurrence condition identifying means, a supply of pressure oil to the lift cylinders via the lift operation valve.

According to the invention, when an occurrence condition which causes a torsional force exerted on the vehicle body frame owing to an operation of the lift cylinders is identified by the torsional force occurrence condition identifying means, the lift cylinder controlling means interrupts, in response to an identification signal, a supply of pressure oil to the lift cylinders via the lift operation valve, so that the operation of the lift cylinders is stopped. This arrangement prevents such an inconvenience that either one of the lift cylinders reaches its stroke end more quickly than the other, creating an extensive force to the lift cylinder which has not reached its stroke end, for instance, during a tilt-operation of the bulldozer blade, and this causes an extensive torsional force to be exerted on the vehicle body frame through the mounting part of the lift cylinder. Usually, a piston valve is mounted on each lift cylinder and a hydraulic system for a bulldozer is arranged such that the head and bottom of pressure oil pipeline are connected to each other at the cylinder stroke end in order to reduce the above-noted torsional force. In this arrangement, if the flow rate of the pump is increased to increase blade raising speed, damage to the above piston valve due to pressure is increased, resulting in an occurrence of extremely great torsional force. As described earlier, the invention is designed to stop the operation of the lift cylinders, thereby preventing an occurrence of such torsional force.

The torsional force occurrence condition identifying means may be a stroke end detecting means for detecting that the piston of either one of the lift cylinders has reached a stroke end.

In the invention, the lift cylinder controlling means may stop the operation of the lift cylinders by shutting off a pilot circuit for transmitting an operation instruction entered by operation of an operation lever to the lift operation valve. The lift cylinder controlling means may stop the operation of the lift cylinders by shutting off a meter-in switching valve installed in a meter-in circuit for controlling the flow from the lift operation valve to the lift cylinders. The lift cylinder controlling means may be disposed in an electric control circuit and may stop the operation of the lift cylinders by interrupting an operation instruction signal sent to the lift operation valve.

The stroke end detecting means may detect arrival of either of the lift cylinders at its stroke end by detecting a stop of either of yokes with its associated yoke angle sensor for detecting the yoke angle of the lift cylinder or by use of cylinder stroke sensors provided for the lift cylinders. Alternatively, it may detect arrival of either of the lift cylinders at its stroke end by detecting the difference between the axial forces of cylinder rods provided for the right and left lift cylinders, by detecting the difference between loads imposed on cylinder rod pins provided for the lift cylinders, or by detecting the difference between loads imposed on yoke pins provided at the mounting parts of the lift cylinders.

The invention also provides a second hydraulic system for use in a bulldozer in which a blade is raised or lowered by means of two lift cylinders, the system comprising:

(a) a lift operation valve for switching the direction of operation of the lift cylinders by switching the direction of pressure oil which is supplied to the lift cylinders;

(b) torsional force occurrence condition identifying means for identifying an occurrence condition which causes a torsional force exerted on a vehicle body frame owing to an operation of the lift cylinders; and (c) lift cylinder controlling means for reducing the operation speed of the lift cylinders, by limiting, in response to a signal from the torsional force occurrence condition identifying means, the flow rate of pressure oil supplied to the lift cylinders via the lift operation valve.

According to the invention, when an occurrence condition which causes a torsional force exerted on the vehicle body frame owing to an operation of the lift cylinders is identified by the torsional force occurrence condition identifying means, the lift cylinder controlling means limits, in response to an identification signal, the flow rate of pressure oil supplied to the lift cylinders via the lift operation valve, so that the operation of the lift cylinders is decelerated. This arrangement makes it possible to reduce a torsional force exerted on the vehicle body frame when either of the lift cylinders reaches its stroke end more quickly than the other, for instance, during the tilt-operation of the bulldozer blade.

In the invention, the torsional force occurrence condition identifying means may identify an occurrence condition which causes a torsional force by determining if the piston of either one of the lift cylinders has reached a region in the vicinity of its stroke end, or by determining if the blade is in descending movement. Since the cylinder area subjected to pressure and therefore a torsional force increase when the blade is in descending movement, the lift cylinder control such as described in the invention is particularly effective.

The torsional force occurrence condition identifying means may identify an occurrence condition which causes a torsional force by These and other features of the invention will be understood upon reading of the following description along with the drawings. determining with yoke angle sensors if the difference between the yoke angles of the right and left lift cylinders is equal to or more than a specified value and determining if the blade is in ascending movement. Alternatively, it may identify an occurrence condition of a torsional force by determining if the stroke difference between the right and left tilt cylinders is equal to or more than a specified value.

In the invention, the lift cylinder controlling means may be provided in a two-pump system which has a pipeline for supplying pressure oil to the lift cylinders through a main lift operation valve and a pipeline for supplying pressure oil to the lift cylinders through an auxiliary lift operation valve, and may limit the flow rate of pressure oil supplied to the lift cylinders by shutting off the auxiliary lift operation valve. Alternatively, the lift cylinder controlling means may be provided in a pump system for supplying pressure oil to the lift operation valve, which is designed as an assistance pump system in which a main pump is joined to an assist pump, and may limit the flow rate of pressure oil supplied to the lift cylinders by closing an assistance switching valve inserted in a pressure oil pipeline extending from the assist pump to the main pump. The lift cylinder controlling means may be provided in a pump system for supplying pressure oil to the lift operation valve from a variable displacement hydraulic pump, and may limit the flow rate of pressure oil supplied to the lift cylinders by reducing the amount of oil discharged from the variable displacement hydraulic pump.

BRIEF DESCRIPTION OF THE DRAWINGS

FIGS. 3(*a*) and 3(*b*) are a general view and a partially enlarged view, respectively, and FIG. 3(*c*) is a view of a piston valve.

BEST MODE FOR CARRYING OUT THE INVENTION

Referring now to the accompanying drawings, bulldozer hydraulic systems will be hereinafter described according to preferred embodiments of the invention.

FIRST EMBODIMENT

Figure 1:
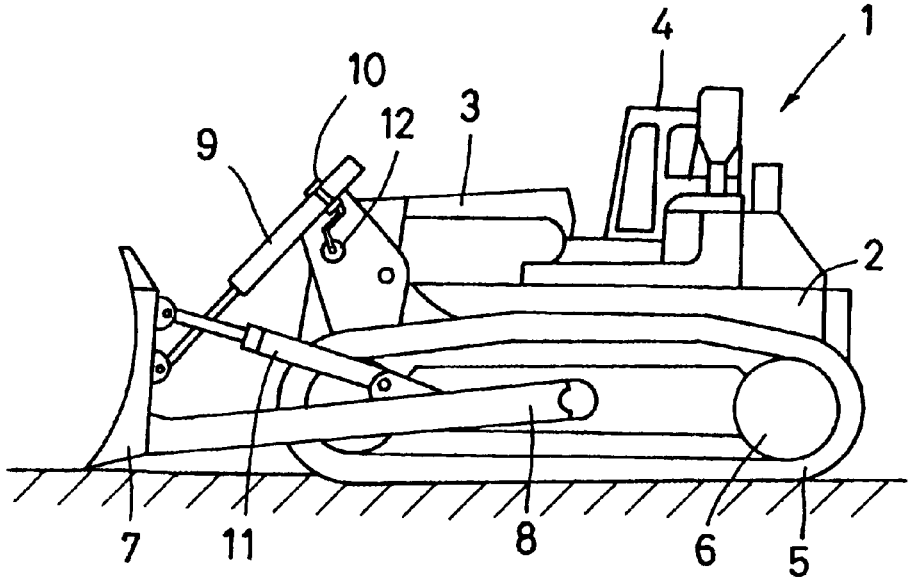
FIG. 1 is a side view of a bulldozer constructed according to a first embodiment.

FIG. 1 shows a side view of a bulldozer constructed according to a first embodiment of the invention. In the bulldozer 1 of the present embodiment, there are provided a bonnet 3 and a cab 4 on a vehicle body 2. Disposed on both right and left sides of the vehicle body 2 when viewed in the forward traveling direction are crawler belts 5 for driving the vehicle body 2 so as to travel forwardly and reversely and turn. The crawler belts 5 are respectively independently driven by driving power transmitted from an engine with the aid of their corresponding sprockets 6.

A blade 7 is provided in front of the vehicle body 2. The blade 7 is supported on the leading ends of right and left straight frames 8 the base ends of which are, in turn, pivotally supported at the sides of the vehicle body 2 through trunnions such that the blade 7 can be raised or lowered in relation to the vehicle body 2.

A pair of side-by-side blade lift cylinders 9 are arranged between the blade 7 and the vehicle body 2 for raising or lowering the blade 7. These blade lift cylinders 9 are supported, at their base ends, by yokes 10 rotatably attached to the vehicle body 2. The other ends of the blade lift cylinders 9 are pivotally supported on the back face of the blade 7. For tilting the blade 7, blade pitch cylinders 11 are disposed between the blade 7 and the right and left straight frames 8.

The vehicle body 2 is provided with yoke angle sensors 12 each of which detects the pivotal angle of each yoke 10 and therefore the angle of each blade lift cylinder 9 with respect to a horizontal plane. The blade lift cylinders 9 are provided with cylinder stroke sensors 13 (shown in only FIG. 2) respectively, for detecting the operation strokes of these cylinders 9.

Figure 2:
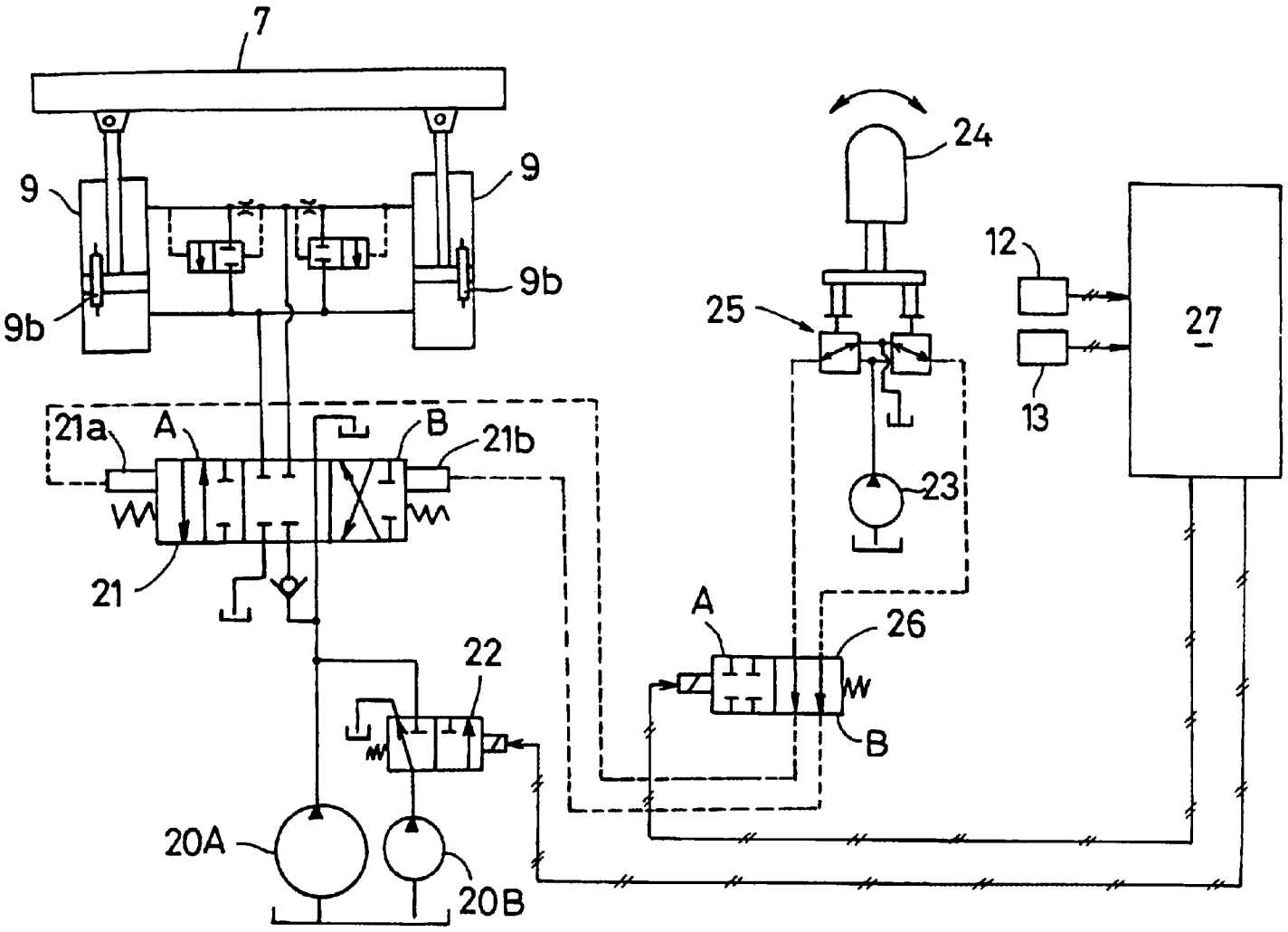
FIG. 2 is a circuit diagram of a blade operation circuit according to the first embodiment.

Referring to FIG. 2 which shows a hydraulic circuit for blade operation according to the present embodiment, a direction control valve (lift operation valve) 21 is connected to the discharge pipeline of a fixed displacement hydraulic pump 20A for supplying pressure oil to the right and left blade lift cylinders 9, and the discharge pipeline of an assistance hydraulic pump 20B is connected to the discharge pipeline of the hydraulic pump 20A via an assistance solenoid valve 22. The discharge pipeline of a pilot pump 23 is connected to a pilot control valve 25 for an operation lever 24. The pilot control valve 25 is connected to the direction control valve (lift operation valve) 21 through a lift control valve 26.

The assistance solenoid valve 22 and the lift control valve 26 are controlled in response to a command from a controller 27. To perform the control operation, the controller 27 inputs a yoke angle signal from each yoke angle sensor 12 for detecting the pivotal angle of each yoke 10 and a stroke signal from each cylinder stroke sensor 13 for detecting the operation stroke of each blade lift cylinder 9.

Figure 3:
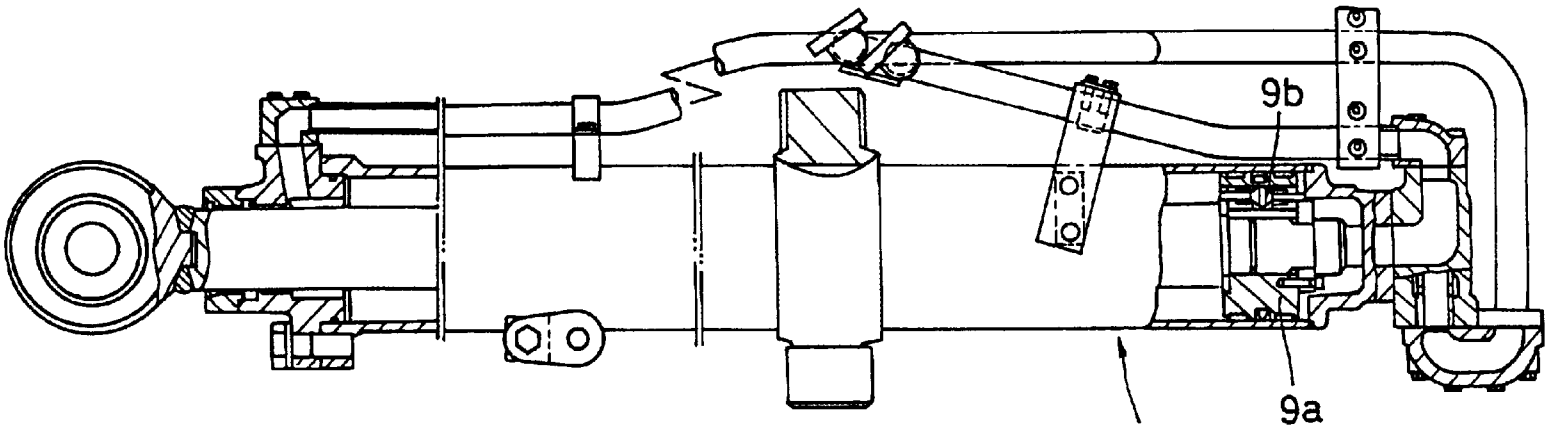
FIGS. 3(*a*), 3(*b*) and 3(*c*) show the structure of a blade lift cylinder.
Figure 3:
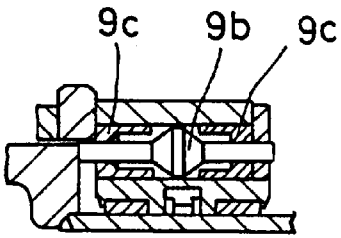
Figure 3:
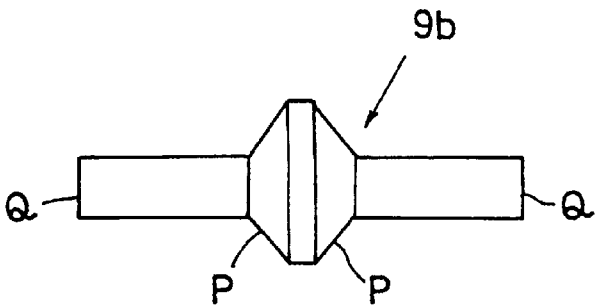

As shown in FIG. 3, each blade lift cylinder 9 has a piston 9*a* provided with a piston valve 9*b*. The piston valve 9*b* has, at its center, inclined surfaces P which serve as seat sections for valve seats 9*c*. There is provided a bar section extending from a side of each inclined surface P and pressure is exerted on the end face Q of each bar section. In the piston valve 9*b* having such a structure, when the piston 9*a* is in operation, being away from the stroke end, the pressure in the cylinder chamber on either the bottom side or head side to which pressure is applied works on the corresponding one of the end faces Q of the piston valve 9*b*, so that the piston valve 9*b* moves until either of the inclined surfaces P of the piston valve 9*b* is brought into contact with its corresponding valve seat 9*c*, thereby closing the oil line. On the other hand, when the piston 9*a* has reached the stroke end, the corresponding one of the end faces Q of the piston valve 9*b* comes in contact with an inner end face of the cylinder chamber so that the piston valve 9*b* reversely moves a specified distance to open the oil line, thereby reducing the pressure difference between the bottom and head sides of the cylinder chamber to reduce stroke speed.

The blade operation circuit of the first embodiment shown in FIG. 2 is operated in the following manner.

When operating the operation lever 24 leftward, the pilot pressure from the pilot pump 23 flows into the lift control valve 26 through the pilot control valve 25. Since the lift control valve 26 is at B-position at that time, the above pilot pressure works on an operating section 21*a* of the direction control valve 21 through the lift control valve 26, so that the direction control valve 21 is shifted to A-position. This allows the pressure oil discharged from the hydraulic pump 20A (and the assistance hydraulic pump 20B) to flow to the direction control valve 21 and then to the head side of the blade lift cylinders 9. As a result, the blade lift cylinders 9 are contracted to thereby raise the blade 7.

On the other hand, when operating the operation lever 24 rightward, the pilot pressure from the pilot pump 23 flows into the lift control valve 26 through the pilot control valve 25. At that time, the lift control valve 26 is also situated at B- position, and therefore, the pilot pressure works on an operating section 21*b* of the direction control valve 21 through the lift control valve 26 so that the direction control valve 21 is shifted to B-position. This allows the pressure oil discharged from the hydraulic pump 20A (and the assistance hydraulic pump 20B) to flow to the direction control valve 21 and then to the bottom side of the blade lift cylinders 9. Consequently, the blade lift cylinders 9 are extended thereby to lower the blade 7.

In the above-described operation for raising or lowering the blade 7, if it is detected from signals released from the yoke angle sensors 12 while the blade 7 being tilt-operated, that either one of the blade lift cylinders 9 has reached its stroke end earlier than the other, the lift control valve 26 is shifted to A-position in response to a command from the controller 27 so that the pilot pressure supplied to the direction control valve 21 is shut off. As a result, the direction control valve 21 is moved back to the neutral position and a supply of pressure oil to the blade lift cylinders 9 is interrupted, thereby stopping the operation of raising or lowering the blade 7. In this way, an occurrence of extensive torsional force to be exerted on the vehicle body frame through the mounting part of the blade lift cylinder 9 (which has not reached its stroke end) can be avoided.

As noted earlier, the blade lift cylinders 9 each have the piston valve 9*b* which allows the fluid communication of the hydraulic lines on the head side and the bottom side when the blade lift cylinders 9 are at their stroke ends, thereby reducing the above-described torsional force. However, when increasing pump flow rate by the assistance hydraulic pump 20B in order to increase the speed of raising the blade 7, damage to the piston valves 9*b* due to pressure increases, causing an extremely extensive torsional force. To cope with this problem, the present embodiment is arranged, as described earlier, to stop the operation of the blade lift cylinders 9 when either of the blade lift cylinders 9 has reached its stroke end earlier than the other, so that an occurrence of torsional force can be avoided.

While a detection signal indicative of the yoke angle of each blade lift cylinder 9 is used for detecting that either one of the blade lift cylinders 9 has reached its stroke end in the present embodiment, a stroke signal from each cylinder stroke sensor 13 for detecting the operation stroke of each blade lift cylinder 9 may be used for the detection. It is also possible to use, in the detection of arrival of either of the blade lift cylinders 9 at its stroke end, the difference between the axial forces of cylinder rods in the blade lift cylinders 9, or the difference between the loads imposed on cylinder rod pins in the blade lift cylinders 9, or the difference between the loads imposed on yoke pins disposed at the mounting parts of the blade lift cylinders 9.

Although the present embodiment is designed to stop the operation of the blade lift cylinders 9 by shutting off the pilot circuit for transmitting an operation instruction from the operation lever 24 to the direction control valve 21, other modifications are possible. For instance, a meter-in circuit switching valve is disposed in a meter-in circuit for controlling the flow from the direction control valve 21 to the blade lift cylinders 9 and the operation of the blade lift cylinders 9 is stopped by shutting off this meter-in circuit switching valve. In the case of an electric control circuit, the interruption of the operation of the blade lift cylinders 9 may be executed by cutting off an operation instruction signal to the direction control valve 21.

SECOND EMBODIMENT

A second embodiment of the invention is designed such that when either of the blade lift cylinders 9 has entered in a specified region which extends from a certain point to its stroke end, the flow rate of pressure oil supplied to the blade lift cylinders 9 is limited in order to cope with the same problem as discussed in the first embodiment.

Figure 4:
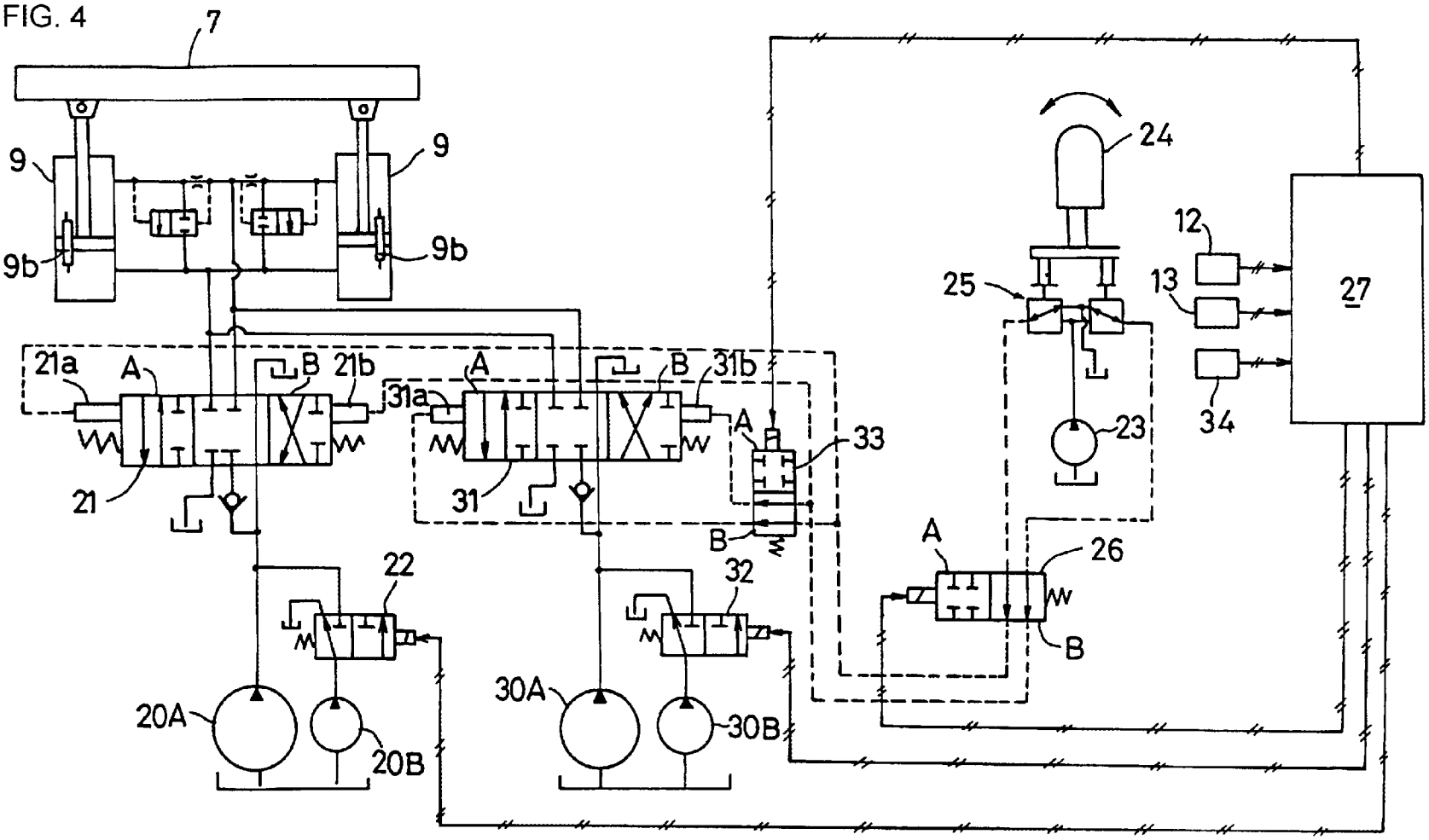
FIG. 4 is a circuit diagram of a blade operation circuit according to a second embodiment.

FIG. 4 shows a circuit diagram of a blade operation circuit designed according to the second embodiment. In this hydraulic circuit, a main direction control valve 21 and an auxiliary direction control valve 31 are provided as direction control valves for controlling pressure oil supplied to the right and left blade lift cylinders 9. There are provided a fixed displacement hydraulic pump 20A and an assistance hydraulic pump 20B which supply pressure oil to the main direction control valve 21. There are also provided a fixed displacement hydraulic pump 30A and an assistance hydraulic pump 30B which supply pressure oil to the auxiliary direction control valve 31. The discharge pipeline of the assistance hydraulic pump 30B is connected to the discharge pipeline of the hydraulic pump 30A through an assistance solenoid valve 32. The discharge pipeline of the pilot pump 23 is connected to the pilot control valve 25 of the operation lever 24. The pilot control valve 25 is connected to the main direction control valve 21 through the lift control valve 26 and to the auxiliary direction control valve 31 through a branch pipeline diverging from the connecting pipeline between the valve 26 and the valve 21. This brunch pipeline is provided with a junction control valve 33.

The assistance solenoid valves 22, 32, the lift control valve 26 and the junction control valve 33 are all controlled according to instructions sent from the controller 27. To perform this control, the controller 27 inputs yoke angle signals from the yoke angle sensors 12 for detecting the pivotal angles of the yokes 10, stroke signals from the cylinder stroke sensors 13 for detecting the operation strokes of the blade lift cylinders 9, and an operating direction output signal from an operation signal output device 34 (e.g., pressure switches and PPC valves) which informs the operating direction of the operation lever 24.

The blade operation circuit of the second embodiment is operated in the following manner.

When operating the operation lever 24 leftward, the pilot pressure from the pilot pump 23 flows into the lift control valve 26 through the pilot control valve 25. Since the lift control valve 26 is at B-position at that time, the above pilot pressure works on an operating section 21*a* of the main direction control valve 21 through the lift control valve 26, so that the direction control valve 21 is shifted to A-position. Simultaneously, since the junction control valve 33 is situated at B-position, the pilot pressure works on the operating section 31*a* of the auxiliary direction control valve 31 through the lift control valve 26 and the junction control valve 33, so that the auxiliary direction control valve 31 is shifted to A-position. This allows the pressure oil discharged from the hydraulic pump 20A (and the assistance hydraulic pump 20B) to flow to the main direction control valve 21 and then to the head side of the blade lift cylinders 9. This also allows the pressure oil discharged from the hydraulic pump 30A (and the assistance hydraulic pump 30B) to flow to the auxiliary direction control valve 31 and then to the head side of the blade lift cylinders 9. As a result, the blade lift cylinders 9 are contracted to thereby raise the blade 7.

On the other hand, when operating the operation lever 24 rightward, the pilot pressure from the pilot pump 23 flows into the lift control valve 26 through the pilot control valve 25. At that time, the lift control valve 26 is also situated at B-position, and therefore, the above pilot pressure works on an operating section 21*b* of the main direction control valve 21 through the lift control valve 26 so that the main direction control valve 21 is shifted to B-position. Simultaneously, since the junction control valve 33 is situated at B-position, the pilot pressure works on the operating section 31*b* of the auxiliary direction control valve 31 through the lift control valve 26 and the junction control valve 33, so that the auxiliary direction control valve 31 is shifted to B-position. This allows the pressure oil discharged from the hydraulic pump 20A (and the assistance hydraulic pump 20B) to flow to the main direction control valve 21 and then to the bottom side of the blade lift cylinders 9. This also allows the pressure oil discharged from the hydraulic pump 30A (and the assistance hydraulic pump 30B) to flow to the auxiliary direction control valve 31 and then to the bottom side of the blade cylinders 9. Consequently, the blade lift cylinders 9 are extended to thereby lower the blade 7.

In the above-described operation for raising or lowering the blade 7, after it is detected from detection signals from the cylinder stroke sensors 13 that the piston 9*a* of either of the blade lift cylinders 9 has reached a specified region extending from a certain point to its stroke end, the junction control valve 33 is shifted to A-position in response to a command from the controller 27 thereby cutting off the pressure oil supplied from the hydraulic pump 30A (and the assistance hydraulic pump 30B) to the blade lift cylinders 9. Therefore, the flow rate of pressure oil supplied to the blade lift cylinders 9 is reduced so that the operation speed of the blade lift cylinders 9 is reduced. In this way, an occurrence of extensive torsional force to be exerted on the vehicle body through the mounting part of the blade lift cylinder 9 (which has not reached the specified region) can be prevented.

Although the second embodiment is arranged to limit the flow rate of pressure oil supplied to the blade lift cylinders 9 based on determination as to whether the piston 9*a* of either of the blade lift cylinders 9 has reached a specified region which extends from a certain point to its stroke end, there are other modifications. One modification is such that the flow rate of pressure oil is limited just after a start of lowering operation in which the blade 7 is operated to descend, according to an operating direction output signal that is released from the operation signal output device 34, indicating the operating direction of the operation lever 24. The reason why the pressure oil flow rate control is performed only during blade lowering operation is that the cylinder area subjected to pressure becomes large, causing a greater torsional force in blade lowering operation. In this modification, it is preferred to limit, during blade raising operation, the flow rate of pressure oil supplied to the blade lift cylinders 9, upon receipt of a detected signal which indicates that the angle of either of the right and left yokes becomes equal to or more than a specified value so that the piston 9*a* of either of the blade lift cylinders 9 has reached a specified region extending from a certain point to the stroke end. In this arrangement, the invention can be applied to the most frequently performed operation, that is, raising of the blade 7 from its earth dumping attitude, so that torsional force exerted on the vehicle body frame during this operation can be reliably limited.

As another modification, the flow rate of pressure oil supplied to the blade lift cylinders 9 may be limited if the stroke difference between the right and left blade tilt cylinders is caused so that the tilt angle of the blade 7 becomes equal to or more than a specified value.

In the second embodiment, the flow rate of pressure oil supplied to the blade lift cylinders 9 is limited by stopping the flow of pressure oil from the auxiliary direction control valve 31 to the blade lift cylinders 9. In the case of the blade operation circuit (assistance pump system) as shown in FIG. 2, the flow rate of pressure oil supplied to the blade lift cylinders 9 can be limited by shutting off the assistance solenoid valve 22. In cases where the main pump is a variable displacement hydraulic pump, the flow rate of pressure oil supplied to the blade lift cylinders 9 can be limited by actuating a variable displacement servo valve for variably adjusting the discharged capacity of this hydraulic pump.

We claim:

1. A hydraulic system for a bulldozer having two lift cylinders for raising or lowering a blade, the system comprising:

(a) a lift operation valve for switching the direction of operation of the lift cylinders by switching the direction of pressure oil which is supplied to the lift cylinders;

(b) torsional force occurrence condition identifying means for identifying an occurrence condition which causes a torsional force exerted on a vehicle body frame owing to an operation of the lift cylinders, and (c) lift cylinder controlling means for stopping the lift cylinders from operating, by interrupting, in response to a signal from the torsional force occurrence condition identifying means, a supply of pressure oil to the lift cylinders via the lift operation valve.

2. A hydraulic system for a bulldozer according to claim 1, wherein said torsional force occurrence condition identifying means is a stroke end detecting means for detecting that the piston of either one of the lift cylinders has reached its stroke end.

3. A hydraulic system for a bulldozer according to claim 1 or 2, wherein said lift cylinder controlling means stops the operation of the lift cylinders by shutting off a pilot circuit for transmitting an operation instruction input by an operation lever to the lift operation valve.

4. A hydraulic system for a bulldozer according to claim 1 or 2, wherein said lift cylinder controlling means stops the operation of the lift cylinders by shutting off a meter-in circuit switching valve provided in a meter-in circuit for controlling the flow from the lift operation valve to the lift cylinders.

5. A hydraulic system for a bulldozer according to claim 1 or 2, wherein said lift cylinder controlling means is disposed in an electric control circuit and stops the operation of the lift cylinders by interrupting an operation instruction signal sent to the lift operation valve.

6. A hydraulic system for a bulldozer according to any one of claim 2, wherein said stroke end detecting means detects arrival of either of the lift cylinders at its stroke end, by detecting a stop of its associated yoke with its associated yoke angle sensor for detecting the yoke angle of said lift cylinder.

7. A hydraulic system for a bulldozer according to any one of claim 2, wherein said stroke end detecting means detects arrival of either of the lift cylinders at its stroke end, by its associated cylinder stroke sensor provided in said lift cylinder.

8. A hydraulic system for a bulldozer according to any one of claim 2, wherein said stroke end detecting means detects arrival of either of the lift cylinders at its stroke end by detecting the difference between the axial forces of cylinder rods provided for the right and left lift cylinders, by detecting the difference between loads imposed on cylinder rod pins provided for the lift cylinders, or by detecting the difference between loads imposed on yoke pins provided at the mounting parts of the lift cylinders.

9. A hydraulic system for a bulldozer having two lift cylinders for raising or lowering a blade, the system comprising:

(a) a lift operation valve for switching the direction of operation of the lift cylinders by switching the direction of pressure oil which is supplied to the lift cylinders;

(b) torsional force occurrence condition identifying means for identifying an occurrence condition which causes a torsional force exerted on a vehicle body frame owing to an operation of the lift cylinders, and (c) lift cylinder controlling means for reducing the operation speed of the lift cylinders, by limiting, in response to a signal from the torsional force occurrence condition identifying means, the flow rate of pressure oil supplied to the lift cylinders via the lift operation valve.

10. A hydraulic system for a bulldozer according to claim 9, wherein said torsional force occurrence condition identifying means identifies an occurrence condition which causes a torsional force, by determining if the piston of either one of the lift cylinders has reached a region in the vicinity of its stroke end.

11. A hydraulic system for a bulldozer according to claim 9, wherein said torsional force occurrence condition identifying means identifies an occurrence condition which causes a torsional force, by determining if the blade is in descending movement.

12. A hydraulic system for a bulldozer according to claim 9, wherein said torsional force occurrence condition identifying means identifies an occurrence condition which causes a torsional force, by determining with yoke angle sensors if the difference between the yoke angles of the right and left lift cylinders is equal to or more than a specified value and determining if the blade is in ascending movement.

13. A hydraulic system for a bulldozer according to claim 9, wherein said torsional force occurrence condition identifying means identifies an occurrence condition which causes a torsional force, by determining if the stroke difference between right and left tilt cylinders is equal to or more than a specified value.

14. A hydraulic system for a bulldozer according to any one of claims 9 to 13, wherein said lift cylinder controlling means is provided in a two-pump system which has a pipeline for supplying pressure oil to the lift cylinders through a main lift operation valve and a pipeline for supplying pressure oil to the lift cylinders through an auxiliary lift operation valve, and limits the flow rate of pressure oil supplied to the lift cylinders by shutting off the auxiliary lift operation valve.

15. A hydraulic system for a bulldozer according to any one of claims 9 to 13, wherein said lift cylinder controlling means is provided in a pump system for supplying pressure oil to the lift operation valve, which is designed as an assistance pump system in which a main pump is joined to an assist pump, and limits the flow rate of pressure oil supplied to the lift cylinders by closing an assistance switching valve inserted in a pressure oil pipeline extending from the assist pump to the main pump.

16. A hydraulic system for a bulldozer according to any one of claims 9 to 13, wherein said lift cylinder controlling means is provided in a pump system for supplying pressure oil to the lift operation valve from a variable displacement hydraulic pump, and limits the flow rate of pressure oil supplied to the lift cylinders by reducing the amount of oil discharged from the variable displacement hydraulic pump.

* * * * *